United States Patent [19]

Muchisky et al.

[11] Patent Number: 4,757,806

[45] Date of Patent: Jul. 19, 1988

[54] PORTABLE MASSAGE UNIT

[76] Inventors: Thomas P. Muchisky, 784 Hawthicket La., Des Peres, Mo. 63131; James V. Young, 35 Benton Pl., St. Louis, Mo. 63104

[21] Appl. No.: 309,827

[22] Filed: Oct. 8, 1981

[51] Int. Cl.[4] ..... A61H 7/00

[52] U.S. Cl. ..... 128/36; 128/46; 15/22 R

[58] Field of Search ..... 128/34–36, 128/44–46, DIG. 15; 74/12, 15.63; 403/109, 110, 359, 361, 383; 16/108, 109; 285/276; 242/316 D; 239/383; 211/89; 132/120 R; 248/314; 15/257 R, 257 A; D6/85, 86, 88, 92–95, 125; D32/21; D24/36, 38, 40, 41

[56] References Cited

U.S. PATENT DOCUMENTS

| | | | |
|---|---|---|---|
| D. 224,008 | 2/1895 | Field | D6/125 |
| D. 251,045 | 2/1979 | Grube | D6/86 |
| D. 263,959 | 4/1982 | Ernest | D32/21 |
| 2,347,554 | 4/1944 | Gothers | 128/36 |
| 2,893,249 | 10/1956 | Arnold | 74/12 |
| 3,063,718 | 11/1962 | Stienkamp | 128/DIG. 15 |
| 3,932,908 | 1/1976 | Bitgood | 15/24 |
| 4,098,266 | 7/1978 | Muchisky | 128/36 |
| 4,219,178 | 8/1980 | Assion | D6/125 X |
| 4,330,158 | 5/1982 | Walters | 308/8.2 |

*Primary Examiner*—Richard J. Apley
*Assistant Examiner*—H. Flaxman
*Attorney, Agent, or Firm*—Polster, Polster & Lucchesi

[57] ABSTRACT

The unit has a power source with a shaft connected to a cable extending to a massage applicator to rotate an eccentric therein, the cable having at both ends drive keys in sliding engagement with the motor and applicator shafts which shafts have accommodating bores to slidingly receive the cable drive keys to thus accommodate tension and compression exerted upon the cable during driving engagement, with a sheath surrounding the cable and having swivel couplings at the sheath ends, the sheath having at each end ferrules connected to the power unit and the applicator by nuts, and having a high strength bearing of stronger material than the applicator near the eccentric, with the applicator having watertight seals, and the applicator structure providing a passageway for the eccentric drive shaft and a ferrule therein, the power unit having a carrying handle receiving and releasably locking the applicator allowing a hand to grasp and carry both the power unit handle and the applicator, with the applicator rear having a textile latch to lock with a belt for holding the applicator.

2 Claims, 2 Drawing Sheets

PORTABLE MASSAGE UNIT

BACKGROUND, FIELD AND SUMMARY OF THE INVENTION

The present invention is concerned with massage devices for therapeutic uses. Massage devices for therapeutic uses, such as disclosed in U.S. Pat. No. 4,098,266 to Muchisky, have been known in the prior art. Such devices create massaging action through the rotation of an eccentric weight within an applicator head. Prior art massage devices have had drive cables with drive keys at their ends coupled to a motor shaft, and to the massage applicator shaft. However, with such couplings linear movement of the cable relative the couplings is inhibited.

Swivel couplings for drive cables are known in the prior art, such as in Muchisky U.S. Pat. No. 4,098,266 which uses a set screw to couple a pair of sleeves. However, it is desirable to have swivel couplings composed of parts that evenly distribute force and can be conveniently assembled and easily handled, yet not easily lost or misplaced.

In prior art massage applicators, separate components are used to accommodate the transmission of power into the applicator. The number of such components increases the time spent in assembly of the applicators, and increases the potential for malfunction of the applicator.

Prior art applicators have used bearings for the transmission shaft, but there has been a need for a bearing located at the maximum stress point close to the rotating eccentric that is stronger than the other bearing material for the shaft.

In the prior art applicator belts have been used to hold a massage applicator to the body. However, belts such as in Muchisky U.S. Pat. No. 4,098,266 have pockets which limit the positioning of the applicator onto the body, and the presence of such pockets also requires more material and labor to be involved in their production than is desired.

In the prior art there is also a need for a massage apparatus having a handle for the power unit and the applicator so that both can be gripped by the hand while the applicator is mounted and secured to the power unit.

It is furthermore desirable to have massage applicators with a minimum of watertight seals to allow use of the applicator under water.

The present invention improves over the prior art. The invention comprises a power unit which has a motor driven shaft to transmit rotary power through a cable to a massage applicator. The massage applicator has a head containing an eccentric driven by a drive shaft which is connected to the cable within the applicator.

The invention comprises means at both the power unit and at the applicator to allow the cable to be slidingly connected for drive transmission so that the cable can slide to accommodate forces exerted upon the cable by coiling and straightening. Such sliding connection recuces friction during cable rotation, reduces stretching of the cable, reduces heat generated by rotation of the cable, reduces the change in the number of RPMs for cable rotation, and reduces stress on the cable.

At the power unit the motor shaft has an outer bore, and a connector member which fits about the motor shaft. The connector has an extension projecting from the shaft which extension has a bore therethrough having a square surface. The flexible drive cable has both of its ends squared to provide drive keys, with the first key extending within the square of the extension to be drivingly and slidingly engaged therewith. This allows rotation of the motor shaft to rotate the cable, but also allows the cable key to slide relative to the connector within the bore of the motor shaft.

At the other end of the cable at the applicator, another sliding-drive connection is provided between the second cable key and the drive shaft of the applicator. The applicator drive shaft has an end bore having a square inner surface which extends into a second bore of larger size. The square bore of the drive shaft slidingly receives the second squared key to be drivingly engaged therewith. However the shaft bores allow the second cable key to slide relative to the applicator to allow cable movement in the response to forces exerted upon the cable.

Thus at both ends of the cable, accommodation for cable movement is provided.

The invention furthermore comprises unique swivel couplings at both ends of the cable. The cable is surrounded by a flexible plastic sheath. At the power unit, a bell sleeve is secured to the power unit and surrounds the motor shaft and the connector. The first end of the sheath firmly fits within one end of a first ferrule sleeve. The ferrule has an outwardly extending cylindrical flange at its end opposite that which receives the sheath. The ferrule flange is fitted against the end of the bell sleeve and secured thereto by a cylindrical nut which fits around the ferrule to hold the ferrule flange against the bell sleeve so that the ferrule may swivel relative thereto.

At the second end of the cable and sheath, a second swivel coupling is provided. A second ferrule firmly receives and holds the second end of the sheath. The second ferrule has a shape similar to the first ferrule, and has an outer end cylindrical flange which fits within a cylindrical bore of the applicator. The second ferrule flange is held in place by a nut which fits around the ferrule and screws into the handle of the applicator to allow the second ferrule to swivel relative to the applicator.

In the case of both swivel arrangements, the nuts are of sufficient size to be handled easily, and both nuts distribute the retaining force evenly against the ferrules, rather than apply force at a single point.

The present invention further comprises a belt arrangement in which a strip of latching textile hook material, such as sold under the trademark Velcro, is secured firmly to the rear side of the applicator head, with the belt being provided with interior and exterior receptive Velcro textile pile surfaces so that the applicator can be latched to the belt. The applicator can be latched in such a fashion that it is not restricted by the confining dimensions of a pocket or other arrangement, and this allows for greater freedom of positioning of the applicator as well as eliminating material required.

The applicator is provided with a watertight seal at its lower end, and its head is divided into two parts which are fitted flush against each other and secured with a watertight seal so as to prevent seepage of water.

The applicator is comprised of a housing made of molded plastic, which is divided at the head end of the applicator into two parts, a top head section, and a lower part. The lower part is molded so as to provide a passageway for the transmission of the drive of the cable to rotate the eccentric shaft and the eccentric. The applicator structure is such that separate parts to provide the transmission are reduced and ease in assembly and repair is facilitated.

The shaft within the applicator is subjected to maximum stress at the end adjacent the eccentric. The present invention comprises a bearing at two locations of the shaft, with the bearing nearest the eccentric being of greater strength than the farther bearing.

The invention further comprises a combined handle and mounting member on top of the power unit. The handle mount has a curved U-shaped upper recess to receive the elongated end of the applicator handle. A projection at the end of the applicator handle fits into a slot in the interior surface of the handle mount so as to prevent movement of the applicator along the handle mount. Two knobs extending from the interior side of the handle mount interior surface are resilient enough to allow the applicator handle to be pushed down beneath the, but yet hold the applicator against the weaker forces which can be applied to the applicator due to jostling or improper handling, but allows the applicator to be removed by a firm upward pull of the hand. The fit of the applicator handle within the handle of the power unit is such that a single hand can be gripped around both to carry the power unit and the applicator.

DESCRIPTION OF THE PREFERRED EMBODIMENT

Figure 1:
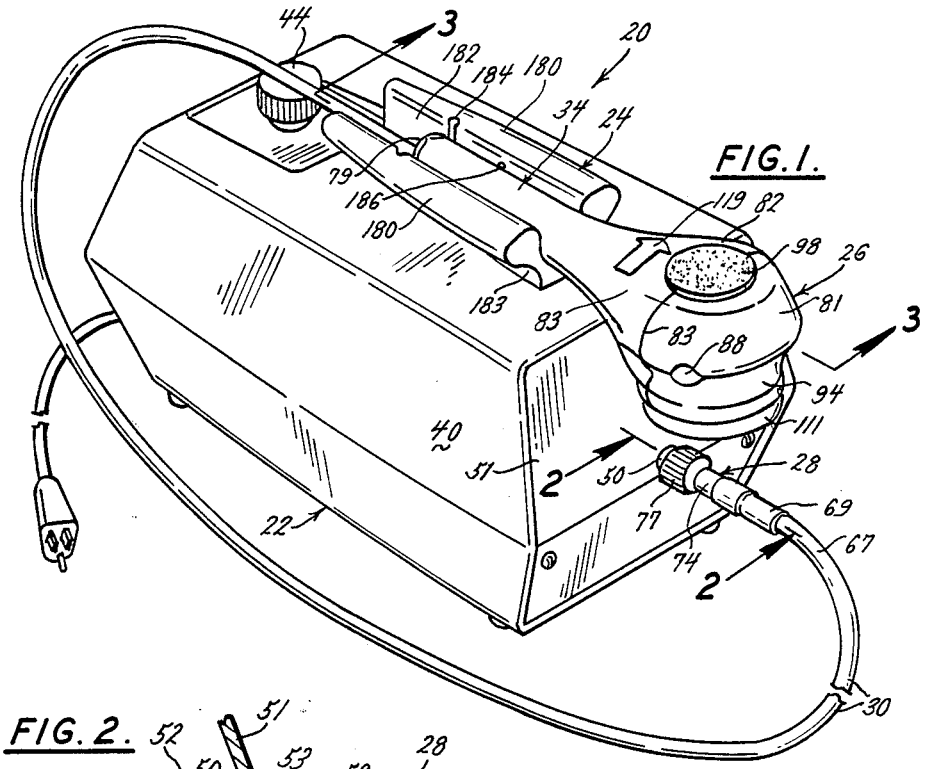
FIG. 1 is a perspective view of the portable massage apparatus showing the applicator mounted on the power unit.

Generally, the portable massage apparatus 20, as seen in the drawings, comprises a power unit 22 having a top handle 24, which also acts as a mounting assembly for holding a massage applicator 26. The output of the power unit 22 is transferred by a motor coupling assembly 28 through a transmission line 30 which is connected to an applicator coupling assembly 32 (See FIG. 3) within a handle section 34 of the applicator. The coupling 32 is drivingly engaged to an eccentric weight 36 mounted for free rotation within the applicator head section 37 to cause the head to vibrate with a directional stroking motion. A belt 38 (FIG. 10) can be used to secure the applicator 26 and hold it against the body for massaging action.

Figure 2:
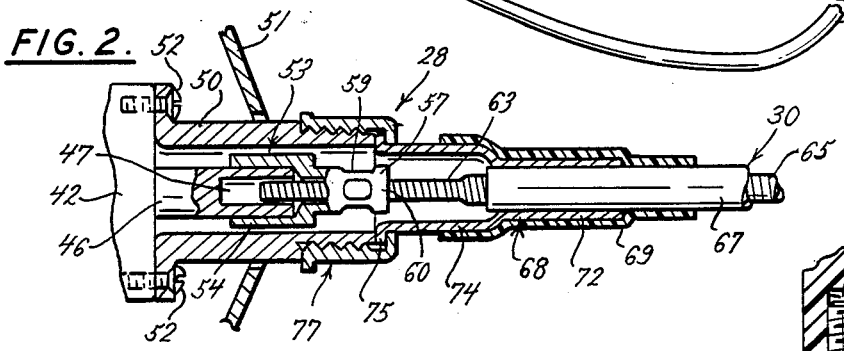
FIG. 2 is a diametrical section taken on the line 2—2 of FIG. 1 showing the coupling assembly for the power unit.

More specifically, the power unit 22 has a housing 40 which contains a variable speed electric motor 42 (part of which is shown in FIG. 2) operated in a standard fashion by a rotatable control knob 44 to give control over the variable speeds of the cylindrical motor drive shaft 46. Shaft 46 has a cylindrical bore 47 at its outer end, and is connected to the coupling assembly 28.

Coupling assembly 28 comprises a bell-shaped sleeve 50 which extends through a bore in the front wall 51 of housing 40, with its circular bell lip secured by screws 52 to the casing of motor 42. Bell 50 has exterior threads at its outer end, and has an inner cylindrical bore within which is located a drive-slide connector sleeve 53. Connector sleeve 53 has an enlarged cylindrically shaped section 54 having a cylindrical bore which telescopically receives the conforming exterior cylindrical surface of motor shaft 46 and is firmly secured thereto as by a strong adhesive so as to be rotatably driven thereby. Sleeve section 54 thence extends outwardly from its shaft connection into a smaller section 57 which has a section 59 that is crimped to form an interior bore with four flat sides which telescopically receives the conforming squared end key 63 of a drive cable 65 to be drivingly engaged thereto. At its outer end section 57 has a conical tapered bore and a circular rim 60 so that the end of section 57 has a bell shape. Drive cable 65 can be a helically coiled spring type cable, and key 63 can be squared through compression. FIGS. 2–8 show the position of the cable 65 when it is extended to be straight, rather than coiled as shown in FIG. 1. Key 63 extends through section 59, and thence into the motor shaft 47. Cable 65 is covered by a cylindrical outer sheath 67 of flexible plastic, which, along with cable 65, comprises transmission line 30.

Coupling assembly 28 further includes a metal swivel ferrule 68 and a layer of plastic adhesive tape 69 that secures sheath 67 to the exterior of ferrule 68 while the sheath 67 is snugly received within the cylindrical bore of the smaller ferrule cylindrical segment 72 and firmly held therein by a strong adhesive. Smaller ferrule segment 72 extends towards the motor shaft into a larger segment 74 having an outer circular flange 75. A cylindrical nut 77 has interior threads screwed onto the exterior threads of bell 50 so that the circular end of the nut holds the ferrule flange 75 flush against the conforming outer circular end of bell 50 for swivel rotation thereagainst. The retaining force of nut 77 is thus distributed evenly over the ferrule and over bell sleeve 50.

Coupling assembly 28 allows motor shaft 46 to rotate cable 65 with cable key 63 slidingly engaged to connector 54. The sliding engagement of the cable allows tensile and compressive forces exerted on cable 65 to slide key 63 freely through the bores of connector 53 fully into and out of shaft bore 47. Yet even though accommodation for movement of the cable is provided by the sliding of key 63 into motor shaft 46, the squared shape of the mobile key and its telescopic fit within the conforming connector sleeve section 57 permits driving engagement of the key when it is fully inserted in the motor shaft bore 47. There is an automatic reengagement if the cable 65 pulls the key 63 with such force as to linearly remove the key 63 from the section 57. When the pulling force is removed from the cable, the spring tension in the cable pushes the key 63 towards the bell shaped rim 60 of section 57. The shape of the circular rim 60 and the conical bore at the end of section 57 then guide the key 63 back into the crimped square section 59 for driving engagement. It is noted that the distance between the outer edge of rim 60 and the interior wall of ferrule section 74 is less than the width of key 63 so that the key 63, if removed from section 57, will not get stuck between section 57 and ferrule segment 74.

Figures 3, 4, 5, 6, 7, 8:
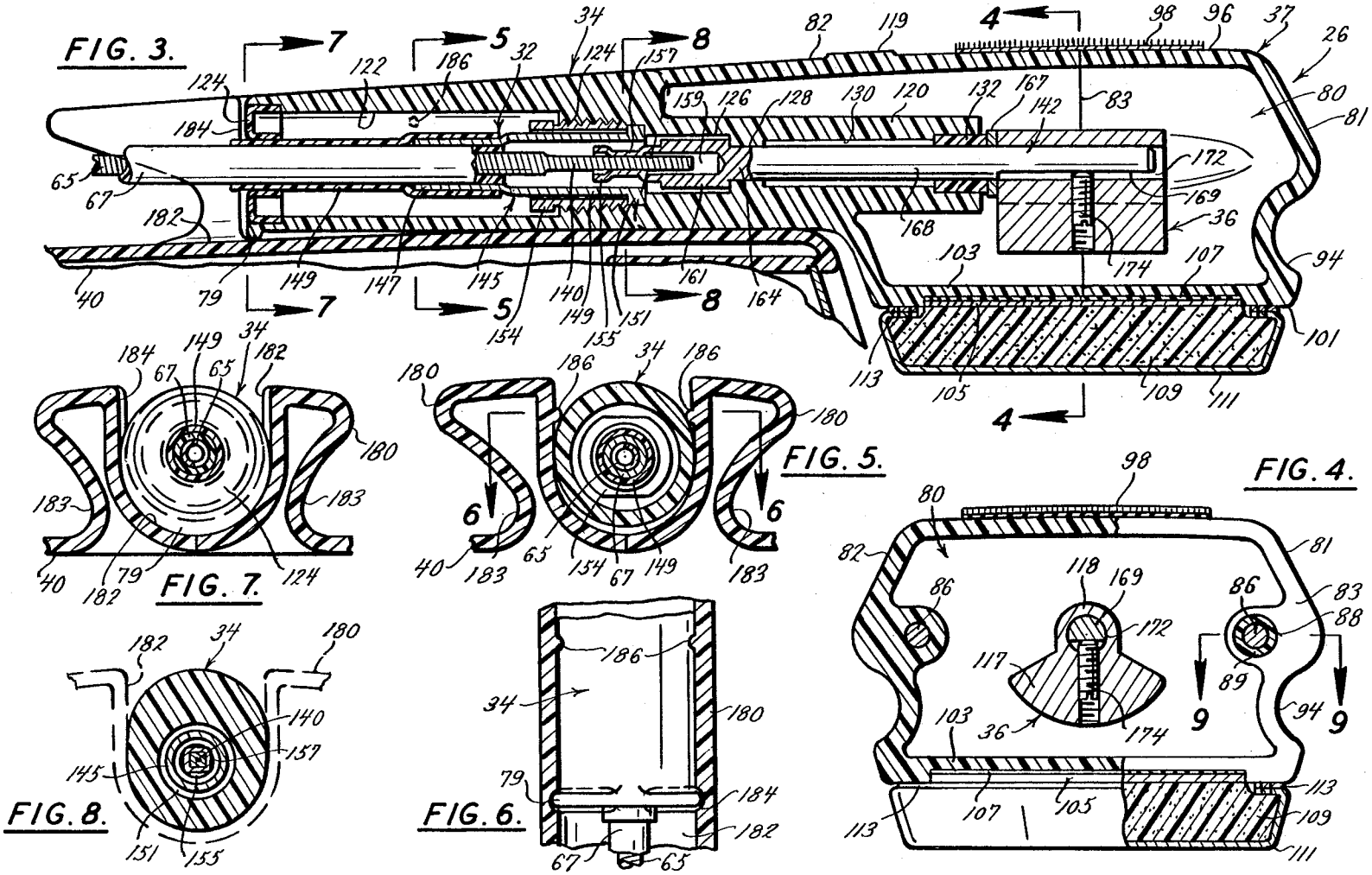
FIG. 3 is a diametrical section, some parts shown in full, taken on the line 3—3 of FIG. 1.
FIG. 4 is an end section taken at the plane of division of the applicator head on the line 4—4 of FIG. 3, showing some portions as viewed from the end of the applicator.
FIG. 5 is a section taken on the line 5—5 of FIG. 3.
FIG. 6 is a section taken on the line 6—6 of FIG. 5.
FIG. 7 is an end section taken on the line 7—7 of FIG. 3.
FIG. 8 is a section taken on the line 8—8 of FIG. 3.

The sheath 67 and cable 65 extend (FIG. 1) into the handle of the applicator 26 (FIG. 3).

First, a description of the structure of applicator 26 will be given, followed by a description of the drive transmission from cable 65 to eccentric 36.

The applicator 26 is comprised of a rigid but lightweight plastic, such as a Nylon (trademark) base plastic, which has a bearing surface characteristic, and has an elongated handle 34 formed at the bottom or lower end of the applicator, with the elongated handle extending upwardly into the larger head 37 at the top of the applicator.

At the lower end of handle 34, a projection 79 extends around approximately the lower half of the handle and slopes back into the smooth surface of the upper half of the handle. Within the head 37 and the upper part of handle 34 is a cavity 80 of sufficient size to allow free rotation of the eccentric 36 therein. The applicator is divided across a plane at about the mid part of the head 37, to form a top head section 81 and a lower part 82 which comprises the lower half of the head, and the handle. Head top 81 has a lower flat edge 83 which fits flush against a corresponding flat edge of the lower part 82 of the divided applicator and is held thereto as by a water resistant silicon adhesive. Both the applicator top head 81 and lower part 82 are formed by injection molding of the plastic.

Figure 9:
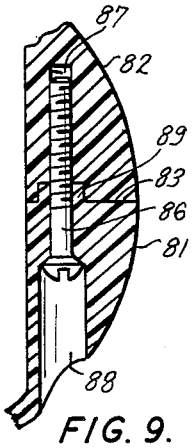
FIG. 9 is a section taken on the line 9—9 of FIG. 4.

The head top 81, in addition to its adhesive seal, is firmly secured to the lower part 83 by a pair of screws 86 (See FIGS. 4 and 9) on opposite sides of the applicator head, with the screws 86 being threaded within threaded bores 87 of lower part 82. Head top 81 has enlarged bores 88 aligned with the screw bores and sized to allow free passage of the screw head, as seen in FIG. 9. The bores 88 allow the screws 86 to be recessed to make it more difficult for accidental removal of the head top 81 to occur. Circular projections 89 are aligned with bores 88 and extend from the edge 83 of head top 81 into circular recessions in applicator part 82, as seen for one such projection 89 in FIG. 9.

The screws 86 and adhesive provide a watertight seal between the flush surfaces of head top 81 and the lower applicator part 82, allowing the applicator to be submerged under water without seepage at that junction.

The head 37 has a rear side 96 which is generally flat, with a circular strip 98 of textile hook latching material, such as sold under the trademark Velcro, secured thereto as by glue. The latching strip 98 extends across the junction of edge 83 of the head top 81. The latching strip 98 acts to secure the applicator to the belt 38, as will be later described.

The front side 101 of the applicator head 81 has a generally flat wall 103 which has a circular recess that receives a circular metal plate 105 secured to wall 103 by a layer of glue 107.

A foam rubber pad 109 is secured as by an adhesive to plate 105. A liner 111 has a circular elastic band 113 which can be stretched around the foam pad 109 to the position shown in FIG. 4 so as to secure liner about pad 109. The elastic band 113 permits the liner 111 to be removed from pad 109 by pulling the elastic band 113 around the outer edges of the pad so that another similar liner with a band can be used as a replacement.

Within the head cavity 80 is the eccentric 36 which comprises a larger fan shaped portion 117 and a smaller semi-cylindrical portion 118 (FIG. 4).

On the rear side 96 of the applicator head beneath the Velcro pad 98 is an arrow 119 to indicate the directional stroking movement created by the eccentric's rotation.

Now attention is directed to the transmission passageway through the applicator, which comprises a series of bores beginning at the handle bottom and extending through the handle and also through a cylindrical extension 120 which projects into cavity 80. At the lower end of the applicator handle is a long cylindrical bore 122 which at its lower end has a larger circular counterbore that receives and holds by a water resistant silicon adhesive the exterior cylindrical side of a circular flexible plastic sealing member 124, having a C-shaped cross section. From bore 122 the transmission passageway moves upwardly in the handle into a smaller concentric threaded bore 124 which at its upper end has a smooth cylindrical portion to receive the circular flanged end of a second ferrule to be described. From bore 124, the transmission passageway extends upwardly into a smaller concentric cylindrical bore 126, and thence through an even smaller concentric cylindrical bore 128 which acts as a bearing for a drive shaft to be described. From bore 128 the passageway extends into a larger concentric cylindrical bore 130 through extension 120 up to plastic bearing 132. Bearing 132 has a cylindrical outer surface that fits and is firmly held by an adhesive within a cylindrical bore at the upper end of extension 120. Bearing 132 is made of a high strength plastic such as sold under the trademark Cadco Nylon 101 manufactured by T.F.E. Industries of Kalamazoo, Mich. (owned by Dayco Corp.), which is a stronger material than the plastic of which the rest of the applicator is molded. Bearing 132 has an inner cylindrical bore which receives and guides a shaft to be described.

Returning now to the bottom of the handle, the engagement of the coupling assembly 32 to cable 65 and sheath 67 shall now be described. The cable 65 has a squared end key 140, formed in the same fashion as key 63, which acts to drive a drive shaft 142 to rotate eccentric 36.

A metal swivel ferrule 145, of the same general shape as ferrule 68, has a smaller cylindrical end 147 having a cylindrical bore with the end of sheath 67 firmly held within that bore as by a strong adhesive. A layer of plastic adhesive tape 149 secures the outer surface of the sheath 67 to the outer surface of ferrule section 147. The lower end of the tape extends through sealing member 124, and the inside cylindrical wall of member 124 presses firmly against the outside of tape 149 and is glued thereto by a water resistant silicon type adhesive to provide a watertight seal to prevent water seepage into bore 122 during submersion of the applicator under water.

The ferrule smaller segment 147 extends into a larger cylindrical segment 149 having at its upper end an enlarged circular flange 151 whose outer circular edge fits smoothly within the upper end of the smooth portion of bore 124 for rotation therein. The upper end of flange 151 rests against the shoulder formed between bore 126 and bore 124. Ferrule 145 is held for swivel movement in the position shown in FIG. 3 by a cylindrical threaded safety lock nut 154 screwed into the threads of bore 124 with the upper circular end of the nut 154 pressing upon the lower edge of the ferrule flange 151 to evenly distribute retaining force against the ferrule.

The nut head, at the lower end of nut 154, has an irregular and non-standard shape, as seen in FIG. 5, so that a special wrench, rather than a standard wrench, must be used to disengage the nut 154. This design prevents disengagement by an untrained person, which might lead to malfunction of the applicator.

Coupling assembly 32 further provides arrangements to drivingly and slidingly engage shaft 142 to key 140. The outer or lower end of shaft 142 has a conical bore which extends outwardly into a circular rim 155. From the conical bore, shaft 142 extends into a section which is crimped at 157 to form four flat sides within the lower bore, similar to that provided in sleeve section 53 previously described. From crimped section 157, the shaft 142 extends into a circular bore 159. The larger part of bore 159 extends through an enlarged cylindrical shaft section 161. The flat interior sides of crimped section 157 telescopically receive the squared key 140 so that the key 140 can slide to and fro within crimped section 157, yet rotation of key 140 exerts torque upon section 157 by virtue of the engagement of the corresponding flat sides, so that shaft 142 is rotated by cable 65.

As explained with regard to the key 63 at the other end of the cable, there is a similar automatic reguidance arrangement for key 140. If key 140 is pulled from engagement with the shaft 142, the circular rim 155 and the conical bore at the end of shaft 142 guided the key 140 back into square section 157. The distance between rim 155 and the interior of ferrule segment 149 is less than the width of key 140 so that the key will not get stuck therebetween.

Shaft section 161 is located within bore 126, and its upper end rests against the shoulder formed between bore 126 and bore 128. From section 161, the shaft extends into a smaller cylindrical neck 164 which passes through applicator bore 128, thence through bore 130, and then through the bore within bearing 132. Bore 128 is axially aligned with the bore of bearing 132, and shaft neck 168 is telescopically received within those bores, so that smooth axial rotation of the shaft is provided.

From bearing 132, neck 164 extends through a circular metal washer 167, and just past washer 167 the neck extends into a chordal shape section (generally cylindrical, with a flat side) 169 which extends through a corresponding chordal shaped bore 172 in the eccentric 36. Eccentric 36 has a threaded bore extending perpendicular to shaft section 169 which receives a set screw 174 that presses against the flat side of shaft section 169 to hold the eccentric against movement relative to the shaft. The corresponding shapes of the shaft section 169 and of the eccentric bore 172 create a driving engagement between the two, so that shaft rotation rotates the eccentric within cavity 80.

The handle and mounting assembly 24 at the top of the power unit 22 is integrally molded with housing 40 and comprises a longitudinal handle 180 having an interior U-shaped surface 182 shaped to receive the lower part of applicator handle 34, as shown in FIG. 1. The side of handle 180 have gripping grooves 183 to receive the finger and thumb of the hand for carrying. A notch 184 is formed in surface 182 and receives the applicator handle projection 79 so that linear movement of the applicator handle from the position shown in FIG. 1 is prevented by the locking of the projection into the groove.

The U-shaped surface 182 has two knobs 186 positioned on opposite sides, as seen in FIG. 5, which act to hold the handle 34 within the U surface 182. The knobs 186 are of a generally cylindrical cross section, and are made of the same material as power unit handle 180. The knobs are resilient so that when the applicator handle 34 is pressed into the surface 182 the knobs give to allow insertion of the handle. The resiliency of the knobs 186 is such that they hold the applicator handle against a jostling type of upward movement of the handle, but are pressed away from the applicator handle when an upward pulling force of the hand is applied against the applicator handle 34.

When the applicator handle 34 is inserted within the U surface of the power handle 24, both the power unit and applicator can be carried by a single hand which grips around the side grooves 183.

The power unit 22 is further provided with an electrical cord and plug for insertion into an electric socket to provide motor power.

Figure 10:
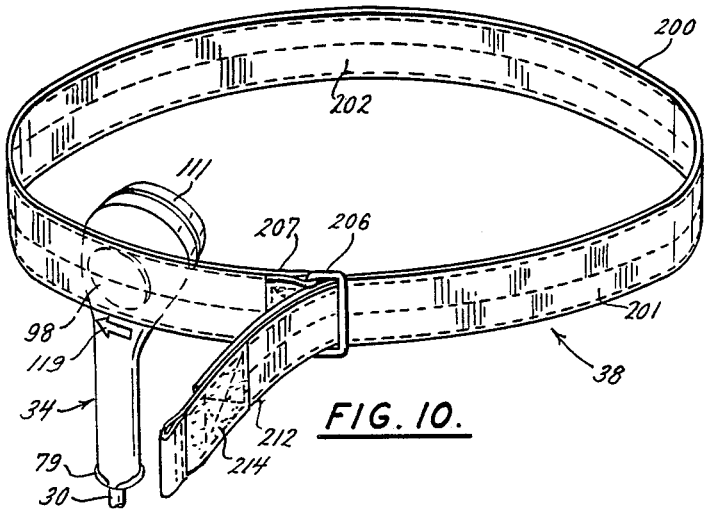
FIG. 10 is a perspective view showing the applicator attached to the belt.

The belt 38, as seen in FIG. 10, comprises belt strip 200 having exterior and interior sides 201 and 202 respectively, each of which have a surface of textile pile to lock with the latching hook strip 98 of the applicator head, such as material sold under the trademark Velcro. When the circular strip 98 is pressed against either belt side, such as the inside 202, as shown in FIG. 10, the applicator 26 is held firmly to the belt, but yet can be removed by holding the belt with one hand and pulling the applicator away from it with the other hand. The belt has a rectangular cinch 206. One end 207 of the belt is looped around one side of the cinch and secured back to the belt strip as by sewing. The other end 212 of the belt strip has a section 214 of latching textile hook latch material, of the same type as head strip 98, sewn thereto.

The belt end 212 can be inserted through the cinch as shown in FIG. 10, and can be turned back so that the hook section 214 can be pressed against the belt's exterior side 201 and locked thereto.

OPERATION

For purposes of illustration the massage apparatus 20 is in the position shown in FIG. 1. In this position the operator's hand can grip the side grooves 183 of mount handle 180 to lift and carry both the power unit and the applicator. To remove the applicator 26 from the mount handle 180, the applicator 26 is grasped at a position such as near the arrow 119 and pulled upwardly so that the knobs 186 are pushed away from the applicator handle 34 and projection 79 at the end of the handle slides upwardly out of the U-slot 184.

The applicator 26 then is gripped about the handle 34, and with the plug engaged to a socket, the knob 44 may be turned to commence rotation of the motor shaft 46. Rotation of shaft 46 rotates connector sleeve 53 which in turn rotates key 63 and cable 65. If the cable 65 is coiled during operation so as to put the cable in compression, the key 63 can slide away from shaft 46 and out of shaft bore 47 but because it remains within crimped section 59 it is still driven by rotation of connector sleeve 53. When the cable is straightened, tension on the cable 65 moves key 63 back into the shaft bore 47 to reduce loss of cable drive force and lessen heat build up.

During operation, as the transmission line 30 is subjected to torque due to turning the applicator, the torque is transmitted from the sheath 67 to the swivel ferrule 73 so that ferrule flange 75 swivels within nut 77 to prevent twisting of the sheath 67.

Rotation of cable 65 drives the cable key 140 which rotates shaft 142 and eccentric 36. At the applicator, coupling assembly 34 also allows for cable play similar to that provided by coupling 28. When the cable 65 is subjected to compression as a result of coiling, the key 140 can slide out of the shaft bore 159 but still remain within the driving grips of crimped sections 157. When the cable is straightened again, the cable key 140 can slide back into bore 159 but still remain in driving engagement with shaft 142. Thus the cable 145 can slide to and fro at each of its end connections to accommodate movement caused by coiling and straightening of the cable. Torque exerted upon the sheath 67 is also transmitted at the applicator to the swivel ferrule 145, which swivels within the applicator to prevent sheath distortion.

In the case of both swivel couplings, the retaining forces against ferrules 68 and 145 is distributed evenly by nuts 77 and 154 respectively. Both ferrules can be removed from their connections to the power unit and the applicator by simply unscrewing the nuts 77 and 154.

In the applicator shaft 142 rotation is guided by the bearing 132, and by the bearing bore 128. The higher strength of bearing 132 gives greater strength at the point of maximum stress of the shaft 142. The fit of the upper shoulder of shaft section 161 against the lower shoulder of bore 128 prevents upward movement of shaft 142, while downward movement of the shaft is prevented by the eccentric's abutment against the washer 167.

If greater play is desired for the cable 65, the bore 159 in shaft 142 can be elongated to accommodate more linear movement of the cable key 140 within it. This can be desired if a longer cable is provided as for use of the applicator under water, such as in a bathtub. With a longer cable, the total movement due to coiling and straightening is potentially greater than with a shorter cable. Likewise for greater play, the bore 47 of the motor shaft 46 can be elongated to allow for deeper thrust of the key 63 into the motor shaft 46. The length of motor shaft 46 and eccentric shaft 142 can both be increased to accommodate greater length of their bores, and the various parts associated with those shafts can be modified accordingly. The length of the cable keys can also be made of different lengths for different sized shaft bores.

Rotation of the eccentric 36 causes head vibration. The liner 111 and pad 109 can be pressed against that part of the human body to which the massaging force is desired to be applied. This vibrational force acts to provide a directional stroking force to the body in the direction of the arrow 119. This force can be used to loosen and mobilize bronchial secretions of the lungs, to improve blood circulation in body parts such as the legs, to relax muscles, and to increase profusion of arterial gases.

The liner 111 provides a smooth contact surface for the applicator force. The liner 111 may be used until it wears to the extent that the operator desires to replace it. To replace the liner, the elastic band 113 is stretched to allow the liner to be pulled off the pad 109, and replaced with another like liner. Thus, if the relatively inexpensive liner wears away, it can be replaced without replacing more expensive parts of the applicator which are still in good condition.

The belt 38 allows the operator to attach the applicator to various parts of the body, such as the torso, without the help of an assistant. This is done easily by latching the applicator latch strip 98 to the interior side 202 of the belt. The belt end 212 can then be inserted through the cinch 206 with the applicator liner 111 and pad 109 positioned against the portion of the body to which massaging action is desired to be applied. Then the belt is tightened to the desired position and belt end latching section 214 is secured to the exterior belt surface 200 to hold the applicator pressed against the body. In this way, the applicator force can be applied to difficult to reach spots, such as on the back. The nature of the latching portions of the applicator and the belt allow the applicator to be turned at various angles relative to the belt so that the applicator position is not inhibited by a holding member such as a pocket. Thus, viewing FIG. 10, before the applicator latch strip 98 is latched to the inner belt side 202, the handle 34 can be turned at the desired angle to the belt so as to provide directional stroking in the direction desired.

The material of which the belt 38 and latch strip 98 are composed are sufficiently water resistant to allow their submersions under water. The openings at the lower end of the handle and at the middle of the head are sealed in watertight fashion so that the applicator can be submerged in water, such as warm water for therapeutic purposes, without water seeping into the applicator and interfering with the movement of the parts therein.

The transmission passageway through the applicator which receives the cable 65 and the shaft 142 is conveniently formed so that the cable and shaft may be inserted with the sliding and swivel coupling without the necessity of threading other sleeves within the applicator to form the passageway, yet bores of different sizes are provided in the passageway for the purposes desired.

The density of the material of which the eccentric is composed can vary, and the size of the eccentric too can vary. If desired, means to mount an eccentric on the shaft can be provided so that the distance of the eccentric from the shaft can be varied to allow variation of the moment of inertia of the eccentric relative to the shaft. This can be done as by having the eccentric screw mounted to the shaft, with means in the applicator, such as an opening, to insert a screw driver or the like to move the eccentric towards or away from the axis of the shaft.

Various changes and modifications may be made within this invention as will be readily apparent to those skilled in the art. Such changes and modifications are included within the scope and teaching of this invention as defined by the claims appended hereto.

We claim:

1. A massage assembly for therapeutic use by an individual and for carrying by a human hand comprising:

(a) a massage applicator having a vibrating head and a handle;

(b) a mount for the applicator, the mount comprising a member having a recess for receiving the applicator handle, the recess having resilient projections which allow movement of the applicator handle into the recess to provide a static lock to maintain the applicator handle in the recess but which give to allow the applicator to be removed from the mount by a pull of the hand, wherein the applicator handle has locking means and the mount has locking means for engagement of the applicator handle locking means with the mount locking means to hold the applicator against movement along the axis of the mount recess, and wherein one of the applicator handle and mount member has a projection and the other has a cavity for receiving said projection to lock the handle against movement along the axis of the mount.

2. A massage assembly for therapeutic use by placing it against the body of an individual and for carrying by a human hand comprising:

(a) a massage applicator having a vibrating head and a handle;

(b) a mount for the applicator, the mount comprising a member having a recess for receiving the applicator handle, the recess having resilient projections which allow movement of the applicator handle into the recess to provide a static lock to maintain the applicator handle in the recess but which give to allow the applicator to be removed from the mount by a pull of the hand, and wherein the applicator handle has locking means and the mount has locking means for engagement of the applicator handle locking means with the mount locking means to hold the applicator against movement along the axis of the mount recess in both axial directions.

* * * * *